United States Patent [19]

Ambler

[11] 4,241,634

[45] Dec. 30, 1980

[54] MITRE BOX

[75] Inventor: E. Curtis Ambler, Newington, Conn.

[73] Assignee: The Stanley Works, New Britain, Conn.

[21] Appl. No.: 42,904

[22] Filed: May 29, 1979

[51] Int. Cl.[3] ..... B27G 5/02

[52] U.S. Cl. ..... 83/763; 83/522; 83/581; 83/767; 83/827; 83/829

[58] Field of Search ..... 83/522, 581, 760–767, 83/781, 823, 824, 829, 827; 145/129

[56] References Cited

U.S. PATENT DOCUMENTS

| | | | |
|---|---|---|---|
| 665,693 | 1/1901 | Page | 83/767 |
| 716,384 | 12/1902 | Converse | 83/767 |
| 716,522 | 12/1902 | Converse | 83/767 |
| 1,738,200 | 12/1929 | Pealer | 83/767 |
| 1,949,261 | 2/1934 | Smetak | 83/760 |
| 2,547,121 | 4/1951 | Hess | 83/767 |
| 2,644,493 | 7/1953 | Hempe | 83/763 |
| 3,008,499 | 11/1961 | Hollien | 83/760 |

*Primary Examiner*—Frank T. Yost
*Assistant Examiner*—Robert P. Olszewski

[57] ABSTRACT

A mitre box has a saw guide subassembly rotatably supported on a vertical post and a multiplicity of indents spaced about a portion of its periphery. A wedge member is pivoted on the base member below the saw guide subassembly and is biased to engage an edge portion in one of the indents thereof to prevent its rotation. Positioning means is provided to orient the engagement edge portion of the wedge member in axial alignment with the post to ensure accurate and stable positioning of the subassembly in a predetermined rotated position about the post. The saw guide subassembly may include a fixedly supported saw guide element and a second saw guide element which is carried on the fixed guide element and pivotable relative thereto about a pivot point adjacent the upper edge of the guide elements to equalize the pressure exerted by the ends of the saw guide subassembly on the saw received therebetween.

17 Claims, 16 Drawing Figures

MITRE BOX

BACKGROUND OF THE INVENTION

Miter boxes are widely employed for cutting workpieces at various angles other than right angular or with precise straight cuts, particularly in cabinet making, in framing of door openings and the like, and in making moldings. Various constructions are used and have been proposed for miter boxes varying from simple channel-shaped structures having guide cuts or slots in their opposed walls to very complex and expensive structures providing a pair of guide posts which receive the saw and one (or both) of which may be moved along the miter box bed relative to the other to establish the desired angular relationship of the saw relative to guide surfaces against which the workpiece is placed.

Another type of miter box is one in which a pair of saw guide elements are rotatably supported upon a single post and may be rotated thereabout to establish the desired angular relationship of the saw carried thereby relative to the guide surface and the workpiece. To maintain the saw guide elements in the desired position, they must be locked in the desired rotated position on the post after they have been rotated, and several mechanisms have been proposed therefor. One of the most useful means is a wedge which is movable into and from engagement with detents on a member which is a part of the support structure for the saw guide elements and which is rotatable about the post.

It will be appreciated that any deviation of such a wedge from an axis lying in the plane of the post about which the saw guide elements are rotated will result in a variation of the saw kerf from the desired angular relationship. Moreover, if the elements are not rigidly locked, there is a tendency for the saw to wander and create an uneven kerf.

Another problem that may be encountered when the saw guide members are supported from a common post is a tendency for some variations in spacing to occur between the saw guide elements at the points which restrain the sidewise motion of the saw. As a result, it is possible for the saw to have undesired sidewise motion at one end of the guide elements and to be subject to excessive pressure at the other end, making the sawing action difficult.

It is an object of the present invention to provide a novel miter box using a movable wedge to lock a rotatable saw guide assembly in a preselected rotated position about the post and avoid undesired deviation.

It is also an object to provide such a miter box in which the elements may be fabricated readily and relatively economically, and in which the rotational position of the saw guide assembly relative to the locking wedge and guide surfaces may be calibrated and adjusted.

A further object is to provide such a miter box utilizing relatively rugged construction and permitting facile but precise adjustment of the saw guide assembly into a position wherein it may be quickly and firmly locked.

SUMMARY OF THE INVENTION

It has now been found that the foregoing and related objects can be attained in a miter box including a base member having a horizontal bed surface and a vertical post on said base member extending above the bed surface. A saw guide subassembly is rotatably supported on the post, and includes an index guide segment of arcuate cross section with a multiplicity of indents spaced about the periphery. A wedge member is pivoted adjacent its lower end on the base member below the guide segment and at a point spaced horizontally from the post. It includes an engagement edge portion spaced towards its free upper end from its pivot and towards the guide segment, and this edge portion is engageable in the indents of the guide segment to prevent rotation of the saw guide subassembly about the post. Biasing means biases the wedge member against the guide segment to engage its engagement edge portion in one of the indents, and positioning means on the base member orients the engagement edge portion of the wedge member in axial alignment with the post and thereby ensures substantially accurate and stable rotated positioning of the saw guide subassembly about the post.

In the preferred embodiment, the biasing means acts between the base member and the wedge member at a point spaced above the pivot. The wedge member engagement edge portion extends substantially rectilinearly, and the pivot point is horizontally spaced from the periphery of the guide segment a distance less than the horizontal distance defined by an imaginary line drawn from the pivot to an imaginary line defined by the engagement edge portion when disposed in a vertical position aligned with the axis of the post. Thus, wedge member exerts both a downward and a radial force on the guide segment and thereby the saw guide subassembly.

Desirably, the positioning means includes a vertical guide surface on the base member and means engageable with the wedge member to secure it against the vertical guide surface. The engageable means includes fastener means carried on the vertical guide surface and extending through a slot in the wedge member, and the fastener means is releasable to permit free pivotal movement of the wedge member and is engageable to lock the wedge member in vertical position against the guide surface.

The saw guide subassembly is slidable axially on the post and includes means to lock the saw guide subassembly in axially adjusted position on the post. This locking means conveniently comprises a threaded fastener extending generally radially in the saw guide assembly into frictional engagement with the post. In its preferred aspect, the saw guide subassembly includes a body element and a separate indexing plate providing the indents and rotatable relative to the body element to permit accurate calibration of the angular orientation of the saw guide subassembly relative to the locking wedge and in a predetermined vertical plane. It also includes means for locking the body element and indexing plate in calibrated position. The indents are of generally V-shaped configuration, and the wedge member engagement edge portion is of generally V-shaped cross section to provide enhanced wedging action.

Desirably, the saw guide subassembly includes a first saw guide element rigidly supported relative to the index guide segment and a second saw guide element carried by the first saw guide element, and both saw guide elements have bearing surfaces adjacent the lower end thereof adapted to firmly but slidably seat a saw therebetween. These saw guide elements have cooperating pivot means adjacent their upper edges and located at substantially the midpoint of their length. This provides a pivot point between the upper ends of the guide elements, and adjustable locking means is spaced below the pivot means and in alignment therewith to draw the bearing surfaces of the saw guide elements together about the associated saw. The saw guide elements also have cooperating alignment means adjacent the upper end thereof to effect alignment thereof. Thus, the second saw guide element may rock along its length about the pivot means to equalize the pressure exerted by the bearing surfaces on the associated saw provided by tightening the locking means.

The bearing surfaces are provided by opposed pads adjacent the longitudinal ends on the opposed surfaces of the saw guide elements. The pivot means includes a curvilinear surface on the opposed surface of one of the saw guide elements and a cooperating flat surface on the other opposed surface. The curvilinear surface is arcuate at least longitudinally of the saw guide elements, and the locking means comprises a threaded fastener. The locating means conveniently comprise projections on one of the saw guide elements and cooperating recesses on the other of the guide elements to seat those projections. The edge portion of the wedge member, the axis of the post and the indent engaged by the edge portion lie in a common vertical plane.

DETAILED DESCRIPTION OF THE ILLUSTRATED EMBODIMENTS

Figure 1:
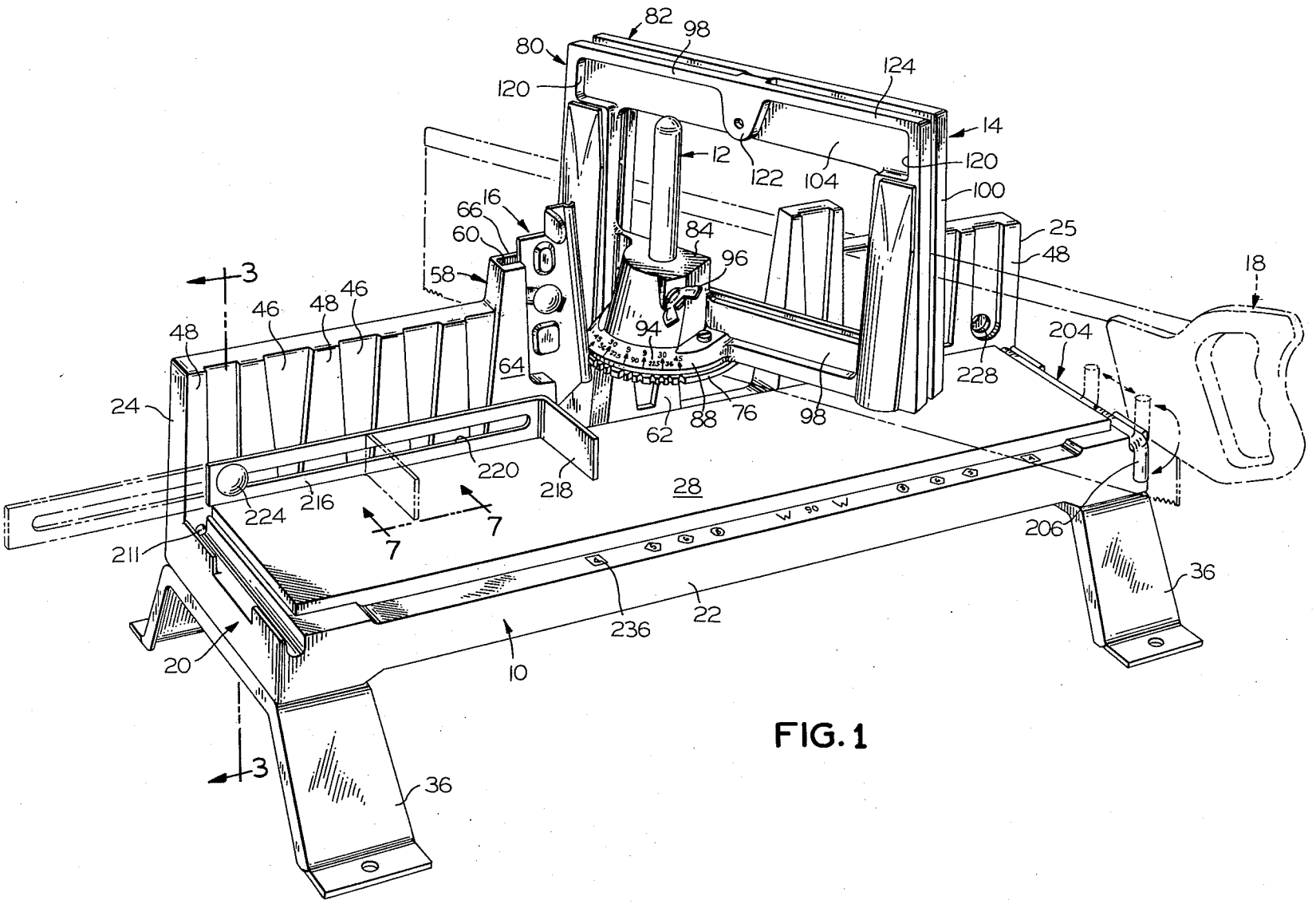
FIG. 1 is a perspective view of a miter box embodying the present invention with a saw shown in phantom line as mounted therein and with the work clamp and length gauges being shown in alternate positions in phantom line.

Referring first in detail in FIG. 1, therein illustrated is a miter box embodying the present invention and generally comprised of a base member generally designated by the numeral 10, a vertical guide post generally designated by the numeral 12, a saw guide subassembly rotatably carried on the post 12 and generally designated by the numeral 14, and a locking wedge subassembly generally designated by the numeral 16 and adapted to lock the saw guide subassembly 14 in various adjusted rotated positions. A back saw of the type used in the miter box is illustrated in phantom line and generally designated by the numeral 18.

Turning now in detail to the base member 10 as best seen if FIGS. 1-5 and 7, it includes a body member generally designated by the numeral 20 having a horizontal bed portion 22 and a pair of vertical guide portions 24,25 extending along its rear margin. The bed portion 22 is provided with a longitudinally extending recess 26 bounded on its rear side by the guide portions 24, 25 and in which is seated the cutting board 28 with its surface extending above the remainder of the upper surface of the bed portion 22.

Figure 3:
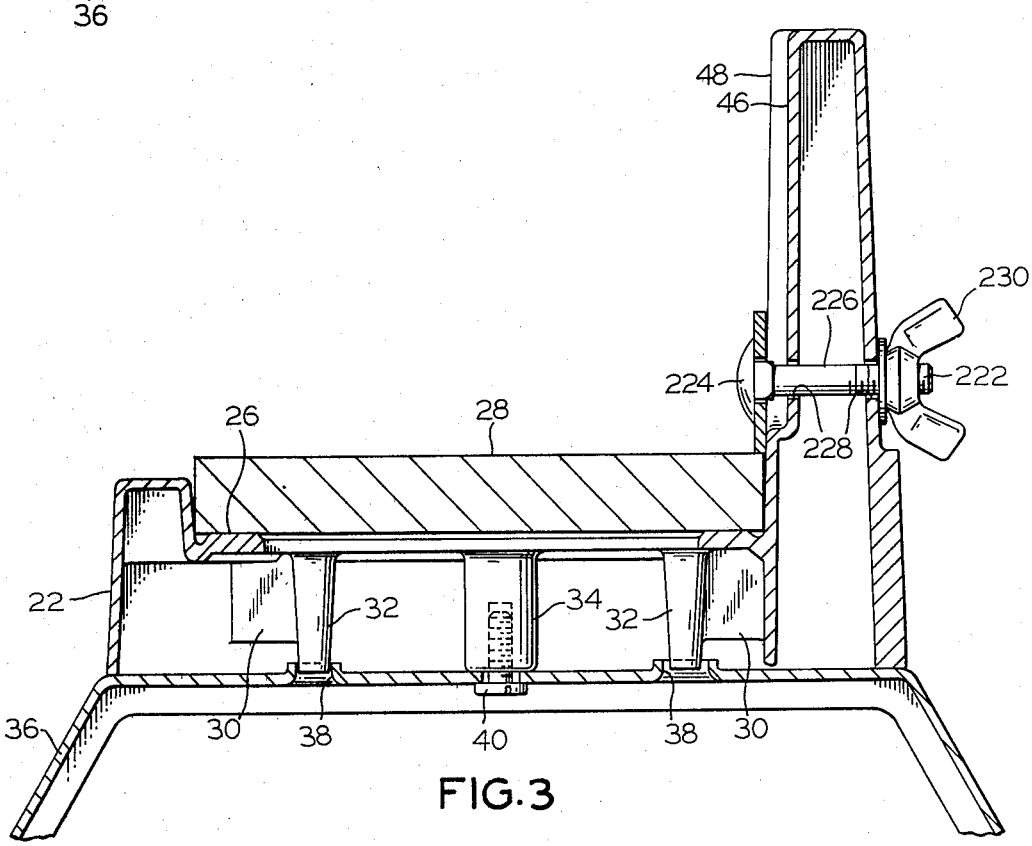
FIG. 3 is a sectional view along the line 3—3 of FIG. 1 and drawn to an enlarged scale.
Figure 7:
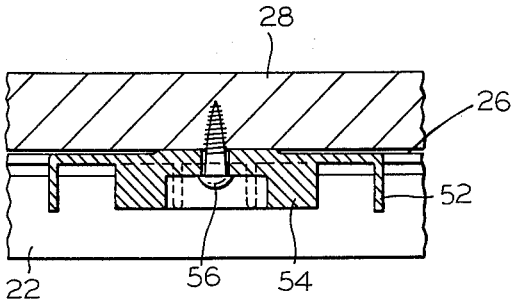
FIG. 7 is a fragmentary sectional view along the line 7—7 of FIG. 1 and drawn to an enlarged scale.

As seen in FIG. 3, the bed portion 22 is cast with depending ribs 30 and bosses 32,34 adjacent its ends. The base member 10 also includes a pair of leg members 36 which are formed with locating recesses 38 to seat the bosses 32, and which are locked to the body member 20 by threaded fasteners 40 which extend therethrough and threadably seat in the bosses 34. As seen in FIG. 7, the bottom surface of the bed portion 22 is also provided intermediate its length with a pair of reinforcing structures defined by ribs 52 which radiate from bosses 54. Screws 56 extend upwardly in the bosses 54 through the bed portion 22 to lock the cutting board 28 in place.

The vertical guide portions 24, 25 are of hollow construction and the inner or front surfaces are defined by vertically extending channels 46 and ribs 48 with the ribs 48 defining a common vertical plane and providing the surface against which the workpiece 50 (seen in FIG. 2) abuts.

At the inner or center edge of the vertical guide portion 24 is integrally formed the support and guide pillar generally designated by the numeral 58 and which has a vertical height greater than the guide portion 24, and a front wall 64 lying in the plane defined by the ribs 48. Formed as a continuation of the base of the pillar 58 is an upstanding pedestal 62 having its front face lying in the plane of the ribs 48 and pillar front wall 64.

The pillar 58 has a generally U-shaped cross section defining a channel 60 opening towards the pedestal 62. The front wall 64 is of generally L-shaped configuration to expose the upper end of the front face of the rear wall 66, and the bed portion 22 has a slot 68 adjacent the rear wall 66 of the pillar 58.

Figure 4:
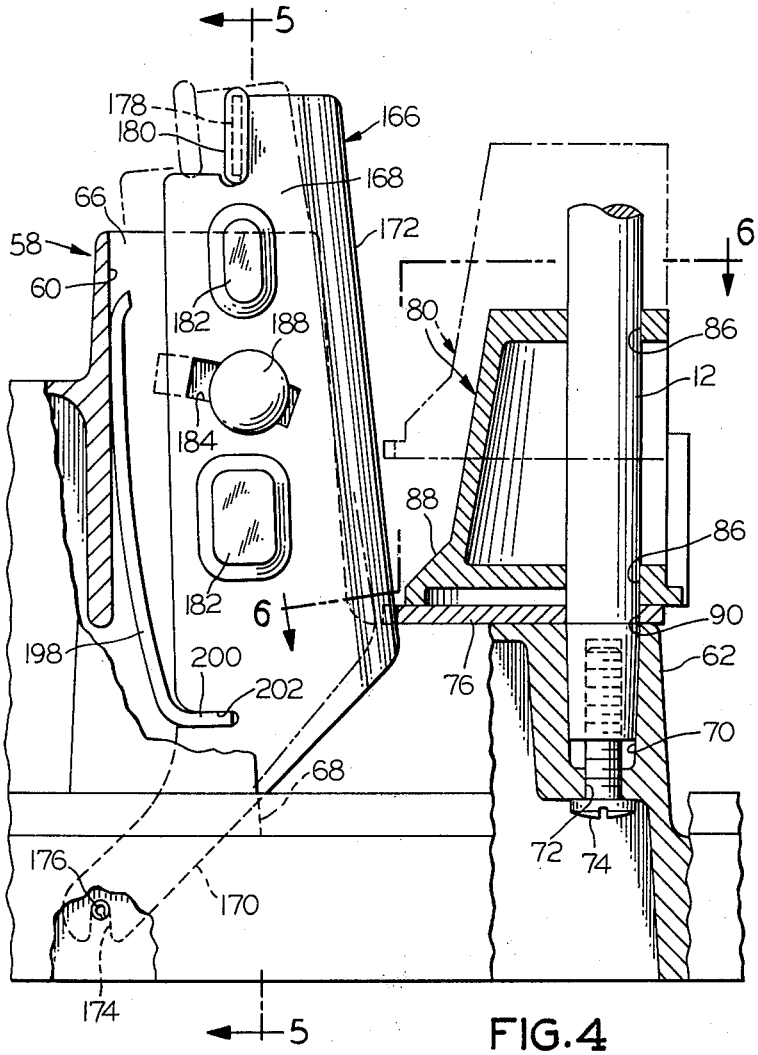
FIG. 4 is a fragmentary sectional view of the box to an enlarged scale showing the wedge and guide segment subassemblies thereof in full line in one position and in phantom line in an alternate position.

As seen in FIG. 4, the pedestal 62 has a generally circular seating recess 70 in its upper surface spaced from the pillar 58 and a coaxial aperture 72 is provided therethrough. Seated in the recess 70 is the post 12, and it is secured therein by the threaded fastener 74 which threadably engages in its lower end.

Figure 6:
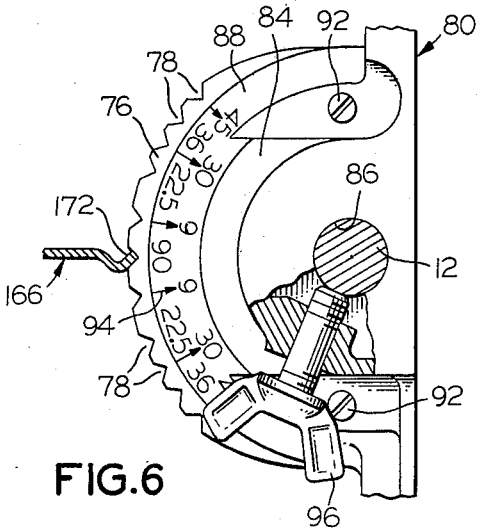
FIG. 6 is a fragmentary sectional view of the wedge and guide segment portion of the assembly of FIG. 4 along the line 6—6 of FIG. 4.

As previously indicated, the post 12 rotatably supports the saw guide subassembly 14 which is also axially slidable thereon. The subassembly 14 includes an arcuate index plate 76 having a multiplicity of V-shaped indents 78 spaced about a portion of its periphery, a first saw guide element generally designated by the numeral 80, and a second saw guide element generally designated by the numeral 82. The first saw guide element 80 has mounting portion 84 having a cylindrical aperture 86 therethrough and in which the post 12 is seated, and the mounting portion 84 has an outwardly flaring arcuate segment 88 at its base adjacent the index plate 76 and of slightly lesser radius. As seen in FIGS. 4 and 6, index plate 76 is a segment of a circle and has an aperture 90 therethrough coaxial with the aperture 86 and through which the post 12 also extends. A pair of locking screws 92 are seated in enlarged apertures in the arcuate segment 88 and extend therethrough and threadably engage in cooperating apertures in the index plate 76 to firmly secure the two members together in a calibrated position. As seen in FIGS. 1 and 6, the arcuate segment 88 has indicia 94 thereon cooperating with the indents 78 of the index plate 76. A wing bolt 96 extends radially through the mounting portion 84 and is threadably seated therein. As seen in FIG. 6, its inner end bears upon the periphery of the post 12 to maintain the saw guide subassembly 14 in a preselected axial position along the length of the post 12.

The first saw guide element 80 also has an upstanding generally rectangular frame portion 98 extending to either side of the mounting portion 84 and on the opposite side of the centerline of the post 12 from the arcuate surface of the segment 88. The second saw guide element 82 is cooperatively configured and dimensioned with respect to the frame portion 98; thus the following description and reference numerals will apply to both.

The saw guide element 82 is of generally rectangular configuration and has vertically extending legs 100, a bottom cross member 102 and a top cross member 104. The inner face 106 of each leg 100 has an elongated, vertical recess 108 extending to its bottom edge, and a vertical slot 110 of lesser width and length extends upwardly from the bottom edge and through the full thickness of the leg within the recess 108. An inverted T-shaped slot 112 extends within the recess 108 at a point above the slot 110, thus providing a transverse shoulder 114 within the recess 108.

Figure 12:
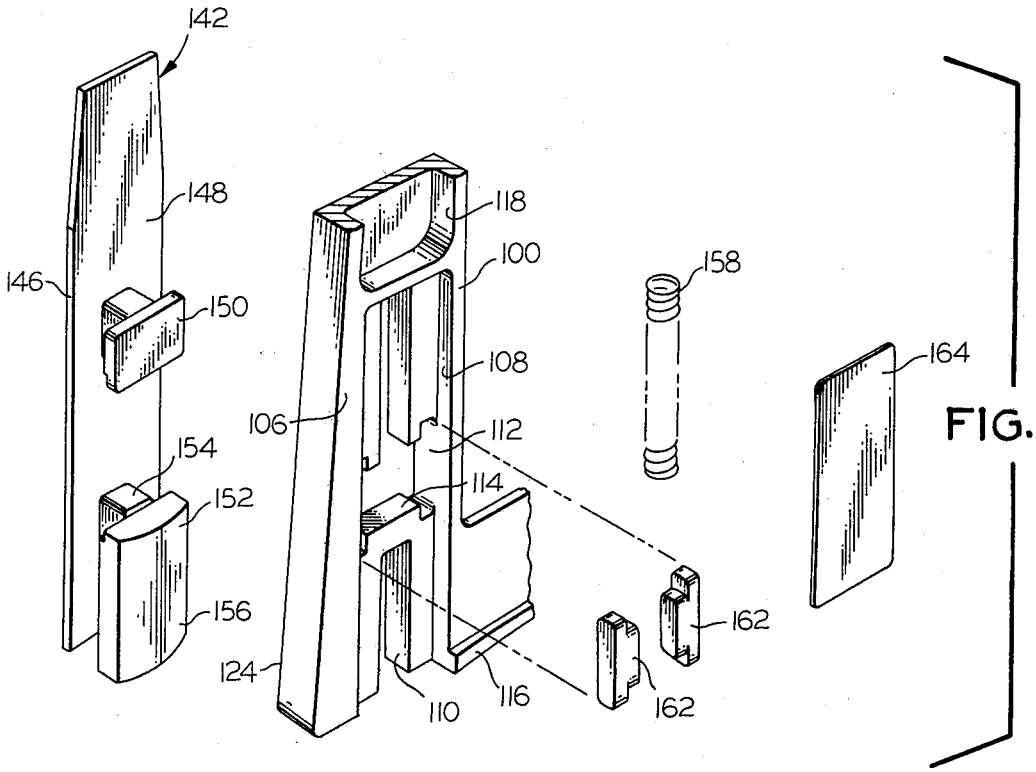
FIG. 12 is a fragmentary exploded view of a saw guide subassembly.
Figure 13:
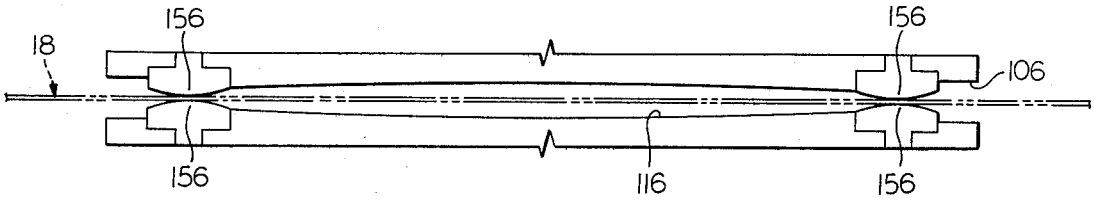
FIG. 13 is a fragmentary partially schematic plan view of the saw guide subassembly showing a saw blade received between the saw guide slides.

As seen in FIGS. 12 and 13, a shallow rib 116 extends along the bottom edge of the bottom cross member 102 on its inner face, and this rib 116 is generally of concave configuration along its length. Small generally rectangular recesses 118 are also provided in the inner face 106 of the legs 100 above the recesses 108. The outer face 124 is provided with a pair of elongated recesses 120 extending along the top cross member 104 and legs 100 and defining a central boss 122 therebetween.

Figure 8:
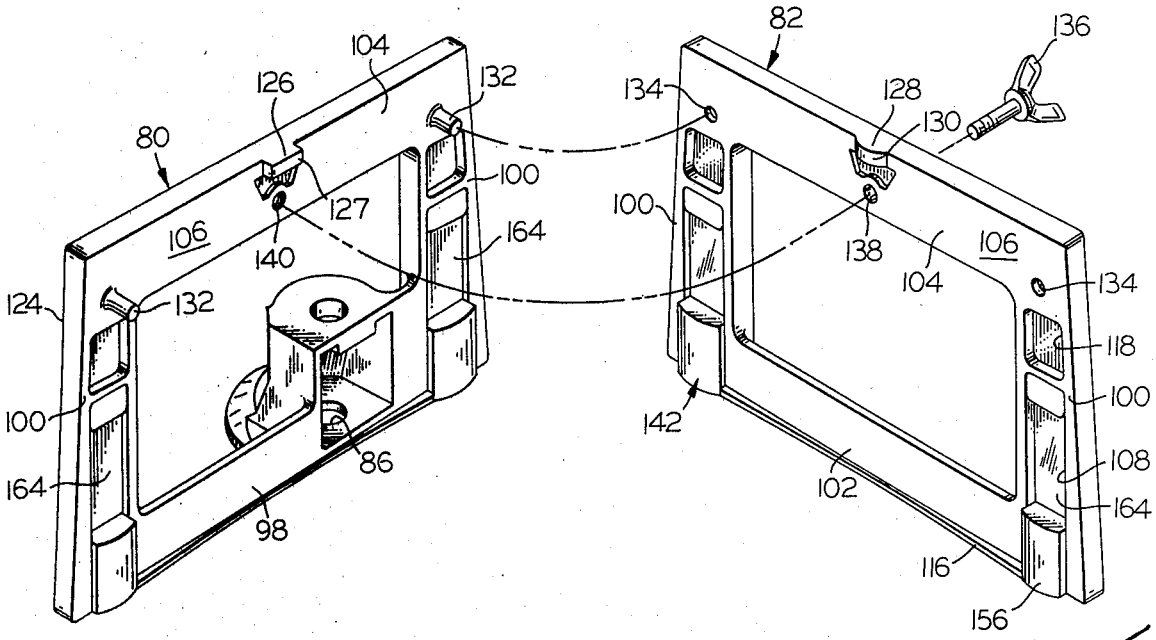
FIG. 8 is a partially exploded view of one embodiment of the saw guide subassembly.
Figure 9:
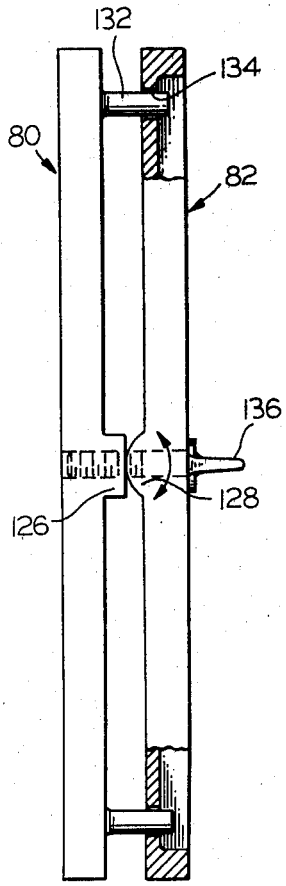
FIG. 9 is a fragmentary plan view of the saw guide subassembly of FIG. 8 with portions broken away for clarity of illustration.

In the embodiment of FIGS. 8 and 9, the first saw guide element 80 is provided with a boss 126 at the midpoint of the inner surface at the top edge of the top cross member 104, and this boss has a planar vertical surface 127. The second saw guide element 82 has a cooperating boss 128 at the midpoint of the top edge of its cross member 104, and this boss has vertical surface 130 which is convex horizontally. In this manner, it may rock on the vertical surface 127 of the boss 126 to permit rocking motion of the second saw guide element 82 longitudinally of the first saw guide element 80. To maintain the two elements 80, 82 in proper orientation, the first saw guide element 80 has a pair of projecting pins 132 on the inner face 106 of its legs 100 adjacent their upper ends, and the second saw guide element 82 has cooperating cylindrical apertures 134 adjacent the upper ends of its legs 100. To lock the elements 80, 82 in assembly, a wing fastener 136 extends through an aperture 138 in the top cross member 104 of the second saw guide element 82 below the boss 128, and this fastener 136 threadably seats in a cooperating threaded aperture 140 of the top cross member 104 of the first saw guide element 80.

Figure 10:
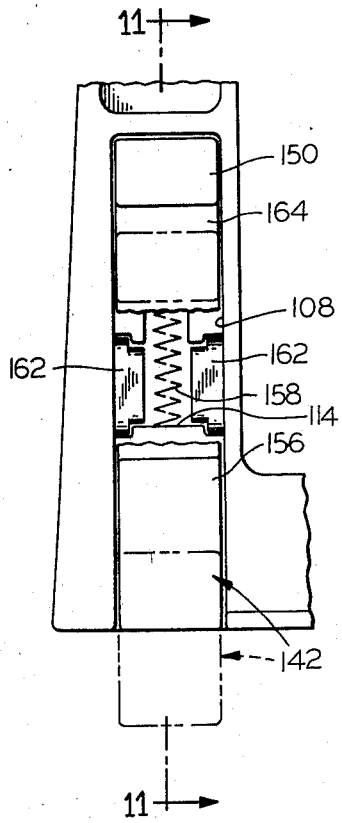
FIG. 10 is a fragmentary elevational view of the inside face of one of the saw guide elements drawn to an enlarged scale with the cover broken away to reveal internal construction and with the slide shown in phantom line in an alternate position.
Figure 11:
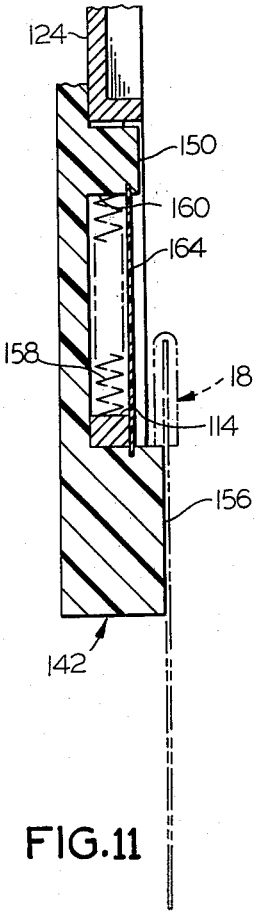
FIG. 11 is a fragmentary sectional view along the line 11—11 of FIG. 10 and showing a saw in phantom line as bearing upon the saw guide slide.

As seen in FIGS. 1–2 and 8–13, slidably seated in the slots 110,112 and recesses 108 of the legs 100 of each of the saw guide elements 80,82 are saw guide slides generally designated by the numeral 142. The saw guide slides 142 have an elongated body portion 146 disposed on the outer face 124 of the legs 100 with a planar inside face 148 adapted to slide along the outer face 124 of the legs 100. Spaced downwardly from the upper end thereof on the inside face 148 is a T-shaped guide projection 150 defined by a stem which extends through and slides within the vertical leg of the slot 112 and a head which slides within the recess 108. Spaced below the guide projection 150, the saw guide slides 142 also have an elongated projection 152 of generally T-shaped cross section defined by the elongated vertical guide stem 154 which extends through and slides within the slot 110 and a head or bearing pad 156 which slides within the recess 108. As best seen in FIG. 11, the head of guide projection 150 is of relatively small thickness so that it lies within the depth of the recess 108; however the bearing pad 156 is of greater thickness and of convex cross section so that its surface projects beyond the planes defined by the inner face 106 and by the shallow rib 116, as seen in FIG. 13.

As seen in FIGS. 10–12, a helical compression spring 158 has one end seated on the transverse shoulder 114 of the guide element 82 and its other end seated against the lower surface 160 of the stem of the guide projection 150 so as to bias the saw guide slides 142 upwardly on the legs 100. To contain compression spring 158 within the confines of the slot 110 to prevent spring buckling when the spring is compressed, a pair of generally T-shaped retainer elements 162 are inserted into the wide or head portion of the T-shaped slot 112. As seen in FIG. 11, a deflectable cover insert 164 is snapped into transverse slots in the opposed faces of the head of the guide projection 150 and the bearing pad 156, thus enclosing the spring 158 and providing the appearance of a continuous surface on the inner face 106 of the guide element 82.

Turning now to the locking wedge subassembly 16, this is best illustrated in FIGS. 3–6. The locking wedge is a stamped plate-like member generally designated by the numeral 166 having a generally vertically extending body portion 168 slidably disposed on the front surface of the rear wall 66 of the pillar 58 and a depending offset pivot portion 170 extending away from the post 12 and through the slot 68 in the bed portion 22. The vertical edge portion of the body portion 168 adjacent the post 12 is bent so that its edge provides a generally V-shaped pawl 172 cooperatively dimensioned and configured to snugly seat within the indents 78 of the index plate 76. The lower end of the pivot portion 170 of the wedge 166 has a downwardly extending slot 174 which receives the spring pivot pin 176 on the body member 20 so as to provide the pivot therefor. Adjacent its upper end, the edge of the body portion 168 spaced from the post 12 has a forwardly projecting arm 178 which may be gripped to effect pivotal movement thereof; a sleeve 180 of synthetic resin is provided thereon to provide a good gripping surface.

Figure 5:
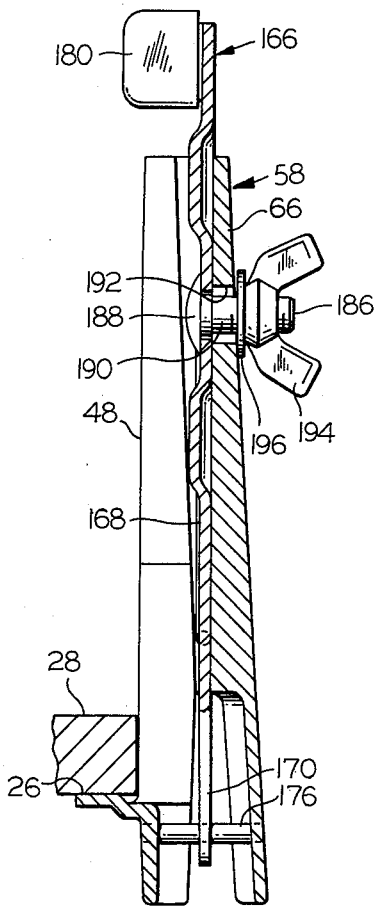
FIG. 5 is a fragmentary sectional view of the assembly of FIG. 4 along the line 5—5 of FIG. 4.

As seen in FIGS. 4 and 5, the body portion 168 has a vertically spaced pair of reinforcing embossments 182 and an arcuate slot 184 therebetween which is inclined downwardly towards the post 12, A threaded fastener 186 has a large head 188 bearing against the front surface of the body portion 168 about the slot 184, and shank 190 extends through the slot 184 and a cooperating circular aperture 192 in the rear wall 66 of the pillar 58. A wing nut 194 on the fastener shank 190 is tightened against the washer 196 and thereby against the rear surface of the rear wall 66 of the pillar 58 to bring the wedge 166 into flush surface contact with the front surface of the rear wall 66 of the pillar 58 and to hold it in that position.

As seen in FIG. 4, the wedge 166 is biased towards the index plate 76 about the pivot pin 176 by a leaf spring 198 having a finger portion 200 at its lower end seated in a slot 202 in the edge of the pivot portion 170 and having its upper end bearing upon the side wall of the pillar 58.

Figure 2:
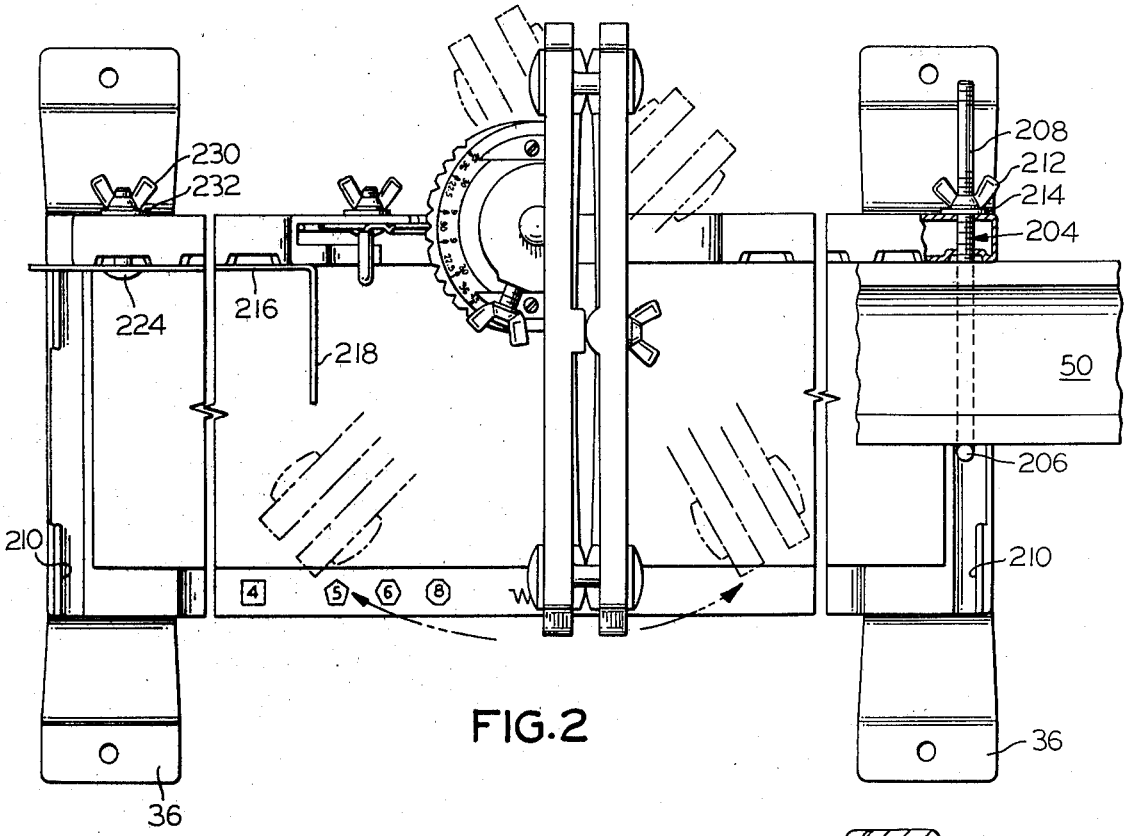
FIG. 2 is a fragmentary plan view of the miter box of FIG. 1 showing the saw guide subassembly in full line in the position for a straight or right angle cut and in phantom lines in positions for angular cuts and also fragmentarily showing a workpiece supported on the bed.

As seen in FIGS. 1 and 2, the secure the workpiece 50 in position against the guide portions 24, 25, clamping means may be provided at either end of the base member 10 by a fastener generally designated by the numeral 204 and having an elongated shank portion 208 which seats in a transverse channel 210 at either end of the upper surface of the bed portion 22 and extends through aligned apertures 211 in the guide portion 25. The perpendicular end portion 206 is disposed against the outer or front surface of the workpiece 50. A wing nut 212 on the threaded end of shank portion 208 may be tightened against the washer 214 and thereby the rear surface of the guide portion 25 to draw the workpiece 50 tightly against the guide portion 25.

As seen in FIGS. 1–3, a length gauge provides a stop for the workpiece 50 at a predetermined spacing from the post 12 and to either side thereof and includes an L-shaped member defined by the elongated leg 216 and forwardly extending foot 218. The leg 216 bears against the front surface of the guide portion 24 (or 25) and has an elongated slot 220 therein. A fastener 222 has an enlarged head 224 bearing against the surface of the leg 216 about the slot 220 and a threaded shank 226 extending through the slot 220 and an aperture 228 in the guide portion 24 (or at the opposite end in the guide portion 25). The wing nut 230 is tightened on the shank 226 against the washer 232 and thereby against the rear surface of the guide portion 24 (or 25) to firmly position the gauge.

As seen in FIGS. 1 and 2, spaced along the front of the bed portion 22 is a series of numerical indicia enclosed in geometric figures, and designated by the numeral 236. These indicia 236 also indicate the angular orientation of the saw 18 relative to the plane defined by the guide portion 24,25 and indicate the cuts to produce the designated geometric figure. For example, the indicium 4 in a square indicates an angular cut of 45° to provide, when mated with other 45° cut members, a four sided figure or rectangle.

Figure 14:
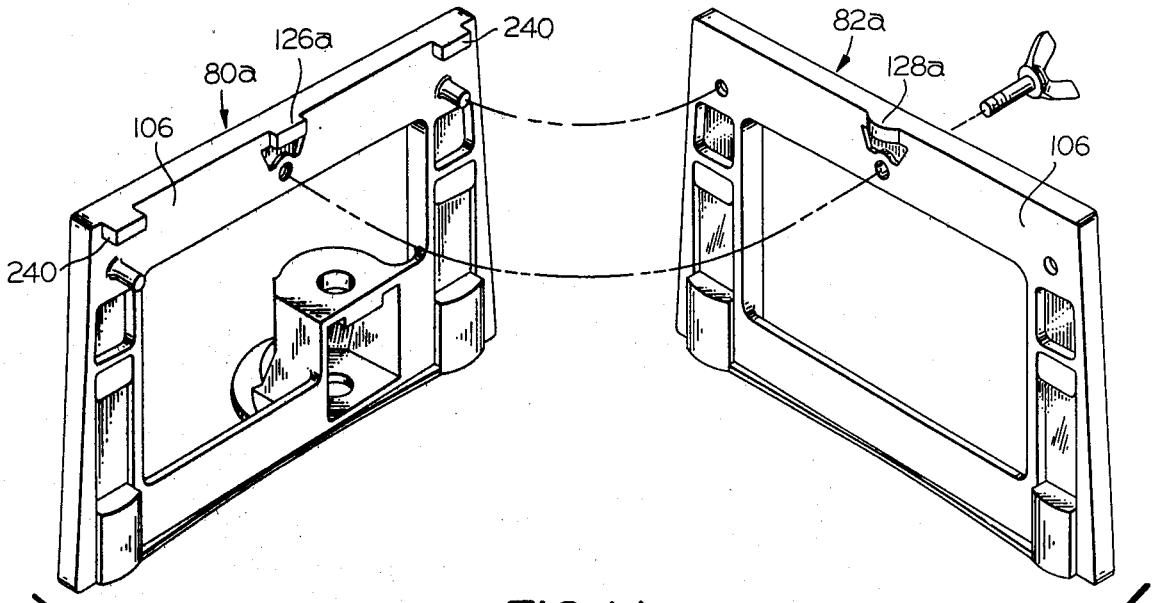
FIG. 14 is a partially exploded view of another embodiment of saw guide subassembly.
Figure 15:
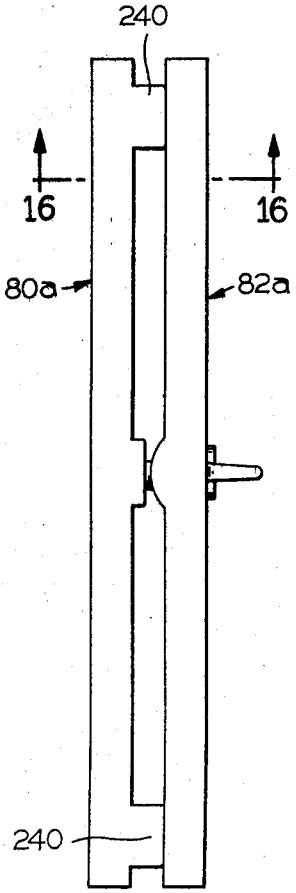
FIG. 15 is a fragmentary plan view of the saw guide subassembly of FIG. 14 with portions broken away for clarity of illustration.
Figure 16:
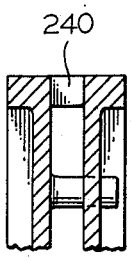
FIG. 16 is a fragmentary sectional view along the line 16—16 of FIG. 15.

Turning now to the embodiment of saw guide subassembly of FIGS. 14–16, the saw guide elements 80*a*, 82*a* are of substantially the same construction as the embodiment of FIGS. 8 and 9 except as described hereafter. Because some users of a miter box are unable to move the saw 18 back and forth in a straight line without producing a sidewise motion which results in a wide and often uneven saw kerf, the longitudinal rocking principle which is permitted by the first embodiment may not be practical for such users. Accordingly, this embodiment eliminates the longitudinal rocking while maintaining the bottom clamping action on the saw. A pair of rectangular bosses 240 are provided on the first saw guide element 80*a* along the upper edge of the inner faces 106 adjacent its longitudinal ends. The total distance that the bosses 126*a*, 128*a* project from the plane of the inner face 106 of the guide elements 80*a*, 82*a* is reduced to slightly less than the distance of projection of the bosses 240 so that the abutment of the bosses 240 against the inner face 106 of the guide element 82*a* defines an even spacing between the two ends of the saw guide elements 80*a*, 82*a*.

Turning now to the method of use of the miter box of the present invention, the back saw 18 must be inserted between the saw guide elements 80, 82 of the saw guide subassembly 14. To do so, the wing fastener 136 is loosened sufficiently to permit the saw 18 to be slid between the two elements 80, 82 with its teeth disposed below the bearing pads 156 and with its back edge portion disposed thereabove.

To adjust the angular setting of the saw guide subassembly 14, the wing nut 194 of the locking wedge subassembly 16 is loosened, and the wedge 166 is pivoted counterclockwise as viewed in FIGS. 1 and 6. The saw guide subassembly 14 is rotated about the post 12 to orient the appropriate indent 78 in substantial alignment with the locking edge portion 172 of the wedge 166. As soon as this alignment has been established, the wedge 166 is released, and the biasing pressure of the spring 198 causes the edge portion 172 to engage in the selected indent 78.

To adjust the vertical height of the saw guide subassembly 14, the wing bolt 96 is loosened sufficiently to allow the saw guide subassembly 14 to slide axially on the post 12 to the desired position which should be approximately ¼ inch above the upper surface of the workpiece 50. Following this adjustment, the wing bolt 96 is tightened to maintain the desired axial setting for the saw guide subassembly 14. The wing nut 194 is then tightened to draw the wedge 166 tightly against the surface of the rear wall 66 and thereby to establish alignment of the edge portion 172, indent 78 and axis of the post 12 in a common plane.

Should the saw guide subassembly 14 require minor angular adjustment or realignment due to inaccurate cuts, the saw guide subassembly 14 should be rotated upon the post 12 to the 90° position, e.g., to orient the saw 18 perpendicular to the plane defined by the front surface of the guide portions 24, 25. The locking wedge subassembly 16 should be tightened to maintain the index plate 76 in this position. The locking screws 92 should then be loosened to permit the arcuate segment 88 to be rotated relative to the index plate 76. A square is held against the front surface of the guide portions 24, 25 and placed against the surface of the saw 18. The saw guide element 80 is then rotated until the saw 18 is at a right angle to the guide portions 24, 25. While the saw guide subassembly 14 is in this position, the locking screws 92 are tightened to effect the desired alignment.

The saw guide subassembly 14 will permit use of saws of various thicknesses since the wing bolt 136 is disposed thereabove and below the spacing determining elements (the bosses 126, 128 in the embodiment of FIGS. 8–9 and the bosses 240 in the embodiment of FIGS. 14–16). When the wing bolt 136 is tightened, the lower portions of the saw guide elements 80, 82 are drawn together tightly against the side surfaces of the saw. It should be tight enough to prevent wobbling action of the saw but not so tight as to prevent smooth back and forth movement of the saw.

In the embodiment of FIGS. 8–9, it can be seen that the two saw guide elements 80, 82 can rock relative to each other in the length direction and compensate for variations in the thickness of the saw 18 or deflection within the guide elements 80, 82. In the embodiment of FIGS. 14–16, this rocking action is substantially eliminated in favor of more rigidity in the side support for the saw 18; this version is preferred for a mass market.

Because the slides 142 are movable downwardly on the guides 80, 82, the saw moves downwardly between the guides 80, 82 until its back edge portion abuts the top of the bearing pads 156, as seen in FIG. 11. The continued sawing action will cause the saw back to move the slides 142 downwardly against the biasing pressure of the spring 158 for the length of travel permitted by the T-slot 112. Upon completion of the sawing action and removal of the saw 18, the slides 142 are biased into this upper position.

When the saw guide subassembly 14 is moved upwardly on the post 12, the wedge subassembly 16 will maintain good locking pressure thereon. As seen in FIG. 4, the pivot pin 176 is spaced from the post 12 (or plate 76) a horizontal distance which is less than that from an imaginary line defined by the edge 172 when in a vertical position. As a result, the wedge subassembly 16 exerts a downward pressure on the plate 76 to enhance the locking action.

The components of the miter box may be fabricated readily from durable materials to provide a relatively long-lived structure. The wedge and index plate are desirably stamped from relatively rigid sheet metal such as steel, and may be plated with nickel and/or chromium to enhance appearance and wear resistance.

The saw guide elements are conveniently cast from aluminum or other metals; however synthetic resins may be also employed, thus permitting injection and compression molding techniques to be used. Although the frame may be molded or cast from resin, the preferred structures use metals such as aluminum and steel. The slides of the saw guide elements may be comprised of any wear resistant resin having a reasonably low coefficient of friction including polyamides, polyacetates and polyolefins.

Thus, it can be seen from the foregoing detailed description and the attached drawings, that the miter box of the present invention provides significant benefits in ensuring alignment of the saw guide subassembly in the desired rotated position. The saw guide subassembly may be calibrated readily relative to the bed, and will accommodate saws of various thicknesses. The elements of the subassembly may be fabricated readily of durable materials to provide a rugged long-lived structure.

I claim:

1. In a miter box, the combination comprising:

A. a base member having a horizontal bed surface;

B. a vertical post on said base member extending above said bed surface;

C. a saw guide subassembly rotatably supported on said post, said saw guide subassembly including an index guide segment of arcuate cross section with a multiplicity of indents spaced about the periphery thereof;

D. a wedge member pivoted adjacent its lower end on said base member below said guide segment and spaced horizontally from said post, said wedge member including an engagement edge portion spaced towards its free upper end from its pivot and towards said guide segment, said edge portion being engageable in said indents of said guide segment to prevent rotation of said saw guide subassembly about said post;

E. means biasing said wedge member against said guide segment to engage said edge portion in one of said indents; and F. positioning means on said base member to orient said engagement edge portion of said wedge member in axial alignment with said post and thereby to ensure substantially accurate and stable rotated positioning of said saw guide subassembly about said post.

2. The combination in accordance with claim 1 wherein said biasing means acts between said base member and said wedge member at a point spaced above said pivot.

3. The combination in accordance with claim 2 wherein said wedge member engagement edge portion extends substantially rectilinearly and wherein said pivot is horizontally spaced from the periphery of said guide segment a distance less than the horizontal distance defined by an imaginary line drawn from said pivot to an imaginary line defined by said engagement edge portion when disposed in a vertical position aligned with the axis of said post.

4. The combination in accordance with claim 3 wherein said wedge member exerts both a downward and a radial force on said guide segment and thereby said saw guide subassembly.

5. The combination in accordance with claim 1 wherein said positioning means includes a vertical guide surface on said base member and means engageable with said wedge member to secure it against said vertical guide surface.

6. The combination in accordance with claim 5 wherein said engageable means includes fastener means carried on said vertical guide surface and extending through a slot in said wedge member, said fastener means being releasable to permit free pivotal movement of said wedge member and engageable to lock said wedge member in vertical position against said guide surface.

7. The combination in accordance with claim 1 wherein said saw guide subassembly is slidable axially on said post and includes means to lock said saw guide subassembly in axially adjusted position on said post.

8. The combination in accordance with claim 7 wherein said locking means comprises a threaded fastener extending generally radially in said saw guide subassembly into frictional engagement with said post.

9. The combination in accordance with claim 1 wherein said saw guide subassembly includes a body element and a separate indexing plate providing said indents, said indexing plate being rotatable relative to said body element to permit accurate calibration of the angular orientation of the saw guide subassembly relative to said locking wedge and in a predetermined vertical plane, said subassembly also including means for locking said body element and indexing plate in calibrated position.

10. The combination in accordance with claim 1 wherein said indents are of generally V-shaped configuration and said wedge member engagement edge portion is of generally V-shaped cross section to provide enhanced wedging action.

11. The combination in accordance with claim 1 wherein said saw guide subassembly includes a first saw guide element rigidly supported relative to said index guide segment and a second saw guide element carried by said first saw guide element, said saw guide elements having bearing surfaces adjacent the lower end thereof adapted to firmly but slidably seat a saw therebetween, said saw guide elements having cooperating pivot means adjacent their upper edges and located at substantially the midpoint of their length, said pivot means providing a pivot point between the upper ends of said guide elements, said saw guide elements having adjustable locking means spaced below said pivot means and in alignment therewith to draw said bearing surfaces of said saw guide elements together about the associated saw, and said saw guide elements also having cooperating alignment means adjacent the upper end thereof to effect alignment thereof, whereby said second saw guide element may rock along its length about said pivot means to equalize the pressure exerted by said bearing surfaces on the associated saw provided by tightening said locking means.

12. The combination in accordance with claim 11 wherein said bearing surfaces are provided by opposed pads on the opposed surfaces of said saw guide elements adjacent the longitudinal ends thereof.

13. The combination in accordance with claim 11 wherein said pivot means includes a curvilinear surface on the opposed surface of one of said saw guide elements and a cooperating flat surface on the other opposed surface.

14. The combination in accordance with claim 13 wherein said curvilinear surface is arcuate longitudinally of the saw guide elements.

15. The combination in accordance with claim 11 wherein said locking means comprises a threaded fastener.

16. The combination in accordance with claim 11 wherein said locating means comprises projections on one of said saw guide elements and cooperating recesses on the other of said guide elements seating said projections.

17. The combination in accordance with claim 1 wherein said edge portion of said wedge member, the axis of said post and the indent engaged by said edge portion lie in a common vertical plane.

* * * * *